US007337907B2

(12) United States Patent
Shah

(10) Patent No.: US 7,337,907 B2
(45) Date of Patent: Mar. 4, 2008

(54) PRESS-FLAT CENTRIFUGE TUBE AND SPECIMEN COLLECTION ASSEMBLY COMPRISING SAME

(75) Inventor: Tilak M. Shah, Cary, NC (US)

(73) Assignee: Polyzen, Inc., Cary, NC (US)

( * ) Notice: Subject to any disclaimer, the term of this patent is extended or adjusted under 35 U.S.C. 154(b) by 186 days.

(21) Appl. No.: 10/633,238

(22) Filed: Aug. 1, 2003

(65) Prior Publication Data

US 2005/0023182 A1 Feb. 3, 2005

(51) Int. Cl.
*B65D 69/00* (2006.01)

(52) U.S. Cl. ..... 206/570; 206/361

(58) Field of Classification Search ..... 206/218, 206/361, 570; 220/6, 666, 667, 650; 215/900; D9/520, 573

See application file for complete search history.

(56) References Cited

U.S. PATENT DOCUMENTS

| | | | | | |
|---|---|---|---|---|---|
| D92,339 | S | * | 5/1934 | Fuerst | D9/573 |
| D163,148 | S | * | 5/1951 | Sterrett | D9/520 |
| D198,407 | S | * | 6/1964 | Amand | D9/543 |
| 3,301,293 | A | * | 1/1967 | Santelli | 220/666 |
| 3,537,498 | A | * | 11/1970 | Amand | 604/403 |
| 3,640,268 | A | | 2/1972 | Davis | |
| 3,727,803 | A | * | 4/1973 | Cobb | 222/215 |
| 3,977,598 | A | | 8/1976 | McDonald | |
| 4,158,376 | A | * | 6/1979 | Erb | 383/120 |
| D258,117 | S | * | 2/1981 | Bashour | D9/543 |
| D267,076 | S | * | 11/1982 | Hurtig | D9/520 |
| D270,331 | S | * | 8/1983 | Benson | D9/520 |
| 4,511,349 | A | | 4/1985 | Nielsen et al. | |
| 4,512,202 | A | | 4/1985 | Wright et al. | |
| 4,552,278 | A | | 11/1985 | Romanauskas | |
| D285,776 | S | * | 9/1986 | Kretz | D9/558 |
| 4,789,639 | A | | 12/1988 | Fleming | |
| 4,803,998 | A | | 2/1989 | Kezes et al. | |
| 4,820,292 | A | | 4/1989 | Korol et al. | |
| 5,174,458 | A | * | 12/1992 | Segati | 215/383 |
| 5,240,130 | A | * | 8/1993 | Osbakk | 215/12.1 |
| 5,255,808 | A | * | 10/1993 | Tobler | 220/6 |
| 5,439,128 | A | * | 8/1995 | Fishman | 220/8 |
| 5,830,154 | A | | 11/1998 | Goldstein et al. | |
| 5,859,374 | A | | 1/1999 | Mink et al. | |
| 6,170,712 | B1 | * | 1/2001 | Kasboske | 222/215 |
| 2002/0197738 | A1 | | 12/2002 | Matsumoto et al . | |
| 2004/0161788 | A1 | | 8/2004 | Chen et al. | |
| 2004/0214316 | A1 | | 10/2004 | O'Connell | |
| 2004/0267181 | A1 | | 12/2004 | Tuite et al. | |

* cited by examiner

*Primary Examiner*—David T. Fidei
(74) *Attorney, Agent, or Firm*—Vincent K. Gustafson; Intellectual Property / Technology Law

(57) ABSTRACT

A centrifuge tube that is compressively flattenable by manual force exerted on opposing surfaces thereof. The centrifuge tube is formed with integral hinge elements at opposing sides thereof. The centrifuge tube of such configuration may be employed as a component of a kit including one or more swab elements, for collection of specimens, forensic evidence, and the like. The swab element may be subjected to squeeze-out action by withdrawing the swab through the slot formed by compressive flattening of the tube, so that the amount of collected material transferred to the tube for subsequent centrifugation processing is maximized.

18 Claims, 7 Drawing Sheets

FIG. 7
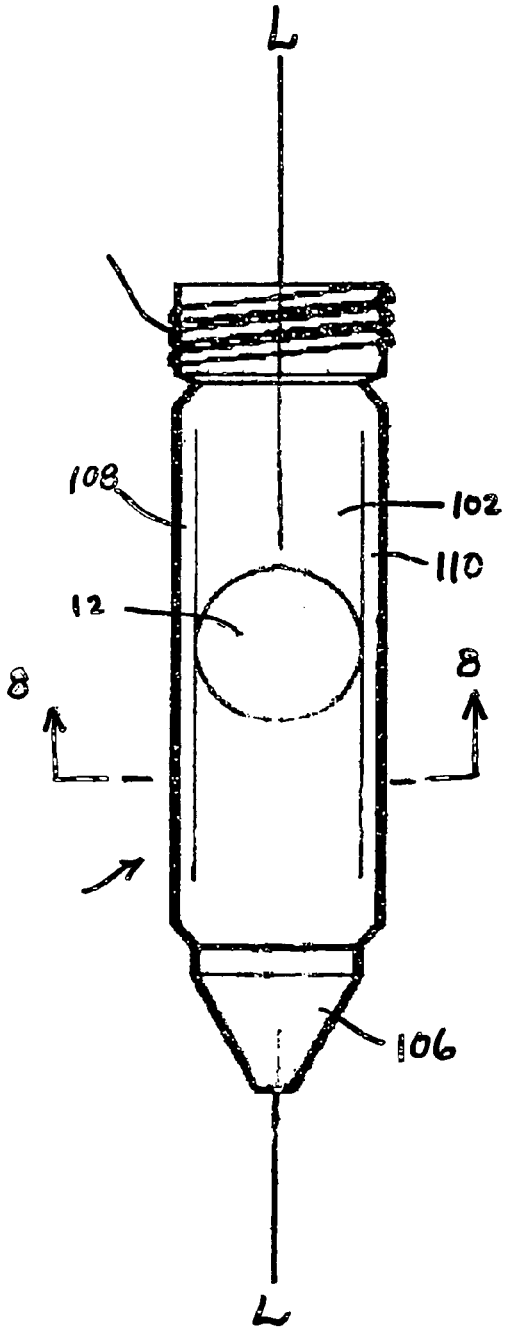
FIG. 6
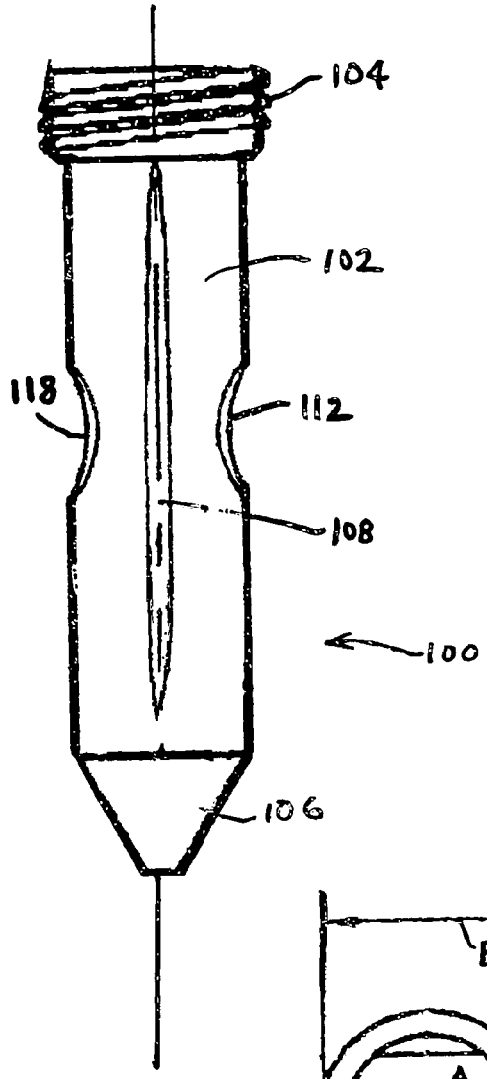
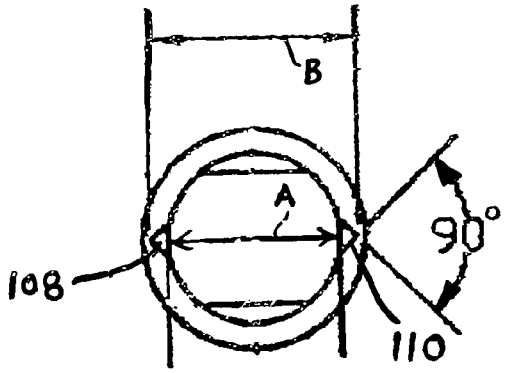
FIG. 8

FIG. 9
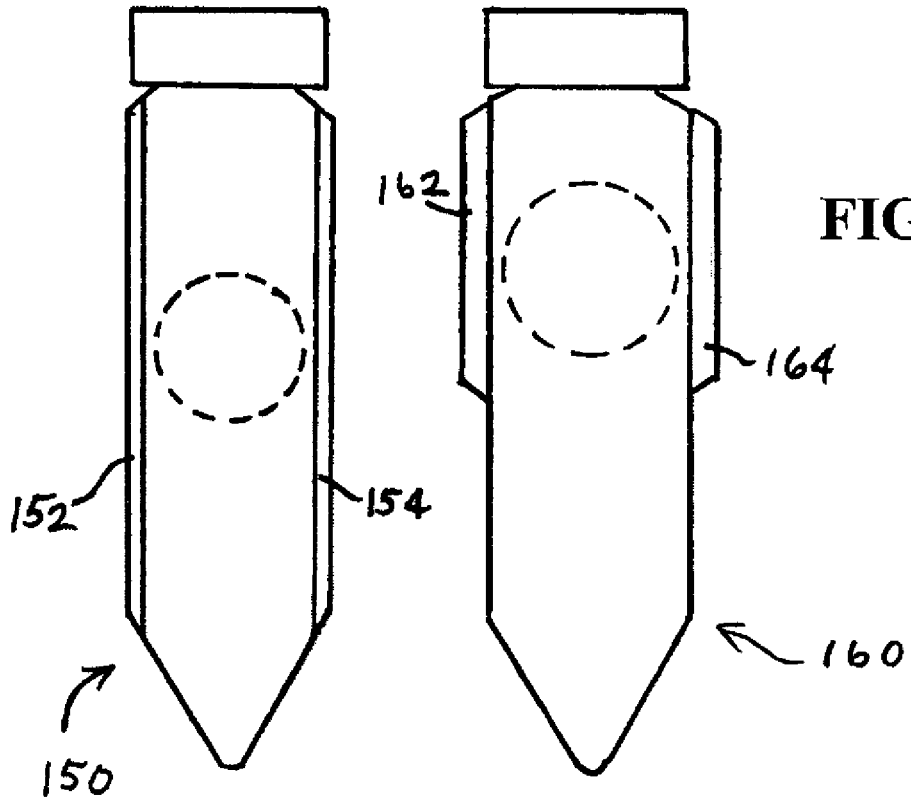
FIG. 10
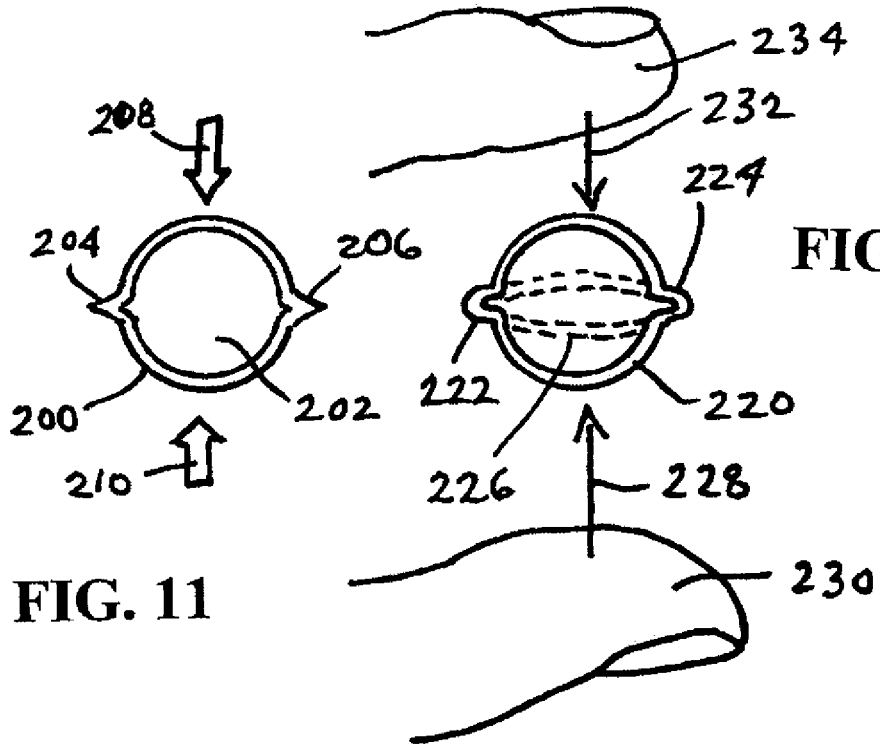
FIG. 12
FIG. 11

PRESS-FLAT CENTRIFUGE TUBE AND SPECIMEN COLLECTION ASSEMBLY COMPRISING SAME

BACKGROUND OF THE INVENTION

1. Field of the Invention

The present invention is directed to a centrifuge tube and to a specimen collection assembly comprising same, such as may be usefully employed for collection of forensic evidence at crime scenes, collection of site samples at sites suspected of contamination with bioterrorism agents, or the like.

2. Description of the Related Art

Centrifuge tubes of widely varying type have been employed for centrifugal separation of specimen samples to isolate components thereof, such as by inserting a collected specimen in the centrifuge tube and adding a wash or elution medium thereto, followed by centrifugation processing, to produce a supernatent liquid and pelleted solids. Alternatively, the wash or elution medium can be added to the centrifuge tube prior to introduction of the collected specimen thereto. In either event, the centrifugation processing produces supernatent and pelleted solids, which can then be separated from each other, e.g., by decanting of the supernatent liquid from the compacted solids mass in the lower end of the centrifuge tube.

Centrifuge tubes of such type are utilized in a wide variety of applications, including collection of forensic evidence at crime scenes, sample collection at suspected bioterrorism sites, collection of chemical contaminants at industrial accident sites, etc.

Frequently, the specimen to be processed in the centrifuge tube is collected by means of a swab including a stick, wand or other elongate member having mounted at its distal end a sorptive or adherent pad for collection of fluid and/or solid samples, for subsequent processing and analysis.

In some instances, the swab element at the distal end of the swab article is sufficiently porous, permeable or adherent so that it is difficult to transfer the collected specimen in its entirety from the swab matrix into the liquid that is added to the tube for centrifugation. Further, the swab element in contacting the liquid in the centrifuge tube for transfer of the specimen will take up the liquid so that when the swab is withdrawn from the centrifuge tube after contacting the liquid therein, the swab element will retain liquid and such liquid in many instances will retain specimen. The retained liquid therefore may significantly reduce the amount of collected sample that is transferred into the liquid in the centrifuge tube, thereby reducing the efficiency and accuracy of the specimen work-up.

Among the centrifuge tubes that have been proposed by the prior art are the tube articles disclosed in: U.S. Pat. No. 3,977,598 issued Aug. 1, 1976 to Bernard McDonald; U.S. Pat. No. 5,859,374 issued Jan. 12, 1999 to Mink et al.; U.S. Pat. No. 4,552,278 issued Nov. 12, 1985 to William A. Romanauskas; U.S. Pat. No. 4,511,349 issued Apr. 16, 1985 to Steven P. Nielson, et al.; and U.S. Pat. No. 4,512,202 issued Apr. 23, 1985 to Herschel E. Wright, et al.

The art therefore is in need of an improved centrifuge tube that permits improved extraction of specimen from a swab element, without substantially increasing the cost or complexity of the tube relative to currently employed tube structures.

SUMMARY OF THE INVENTION

The present invention relates to a centrifuge tube and specimen collection assembly comprising same, in which the centrifuge tube is amenable to being flattened by pressure of opposed digits of a person holding the tube, to provide a narrowed cross-sectional opening of the tube with which a swab used for collection of the specimen can be wiped against the contracted side surfaces of the vial, to thereby wring out liquid in the swab element, after the swab has been wetted with liquid in the centrifuge tube.

The invention in a broad aspect relates to a centrifuge tube having a closed distal end and an open proximal end, with integral hinge elements at opposing sides thereof for facilitating compression flattening of the centrifuge tube.

In another aspect, the invention relates to a molded polymeric centrifuge tube, having a closed distal end and an open proximal end, with an elongate main body portion of generally cylindrical form, with integral hinge elements at opposing sides of the main body portion, extending longitudinally along at least a portion of the length thereof, whereby manual compressive pressure exerted (e.g., by opposing digits) on respective exterior surfaces of the main body portion between the integral hinge elements will effect flattening of the tube at a region of compression of the main body portion. By the provision of integral hinge elements at opposing sides of the main body portion of the centrifuge tube, the manual compressive pressure required for flattening of the centrifuge tube is substantially less than the manual compressive pressure that would be needed to compress the tube in the absence of such integral hinge elements.

In another aspect, the invention relates to a centrifuge tube of the above-described type, in combination with a cap adapted to overlie and close the proximal open end of the centrifuge tube. In a specific aspect, the cap is configured to matably engage the proximal end region of the centrifuge tube.

A further aspect of the invention relates to a specimen collection kit comprising a centrifuge tube as broadly described above, a cap matably engagable with the proximal open end of the centrifuge tube, and a swab article for specimen collection.

In another aspect, the invention relates to a method of making a compressively flattenable centrifuge tube, comprising molding the centrifuge tube with integral hinge elements at opposing sides thereof, wherein such molding comprises extrusion blow molding or rotational molding.

In yet another aspect, the centrifuge tube of the invention is formed with concave depressions on respective surfaces of the main body portion between the integral hinge elements.

Additional aspects, features and embodiments of the invention will be more fully apparent from the ensuing disclosure and appended claims.

BRIEF DESCRIPTION OF THE DRAWINGS

FIG. 6 is a schematic representation of a centrifuge tube according to another embodiment of the invention.

FIG. 7 is a schematic representation of the centrifuge tube of FIG. 6, axially rotated 90° from the position of the tube shown in FIG. 6.

FIG. 8 is a cross-sectional representation of the centrifuge tube of FIG. 6, taken along line 8-8 of FIG. 6.

FIG. 9 is a schematic representation of a centrifuge tube according to another embodiment of the invention.

FIG. 10 is a schematic representation of a centrifuge tube according to yet another embodiment of the invention.

FIG. 11 is a simplified cross-sectional view of a centrifuge tube according to another embodiment of the invention, having a different hinge element structure.

FIG. 12 is a simplified cross-sectional view of a centrifuge tube according to a still further embodiment of the invention, showing the hinge element structure and indicating in dashed line representation the flattened conformation of the centrifuge tube subsequent to exertion of manual compressive force on the tube by the opposing digits of a user, as illustrated.

DETAILED DESCRIPTION OF THE INVENTION, AND PREFERRED EMBODIMENTS THEREOF

Figure 1:
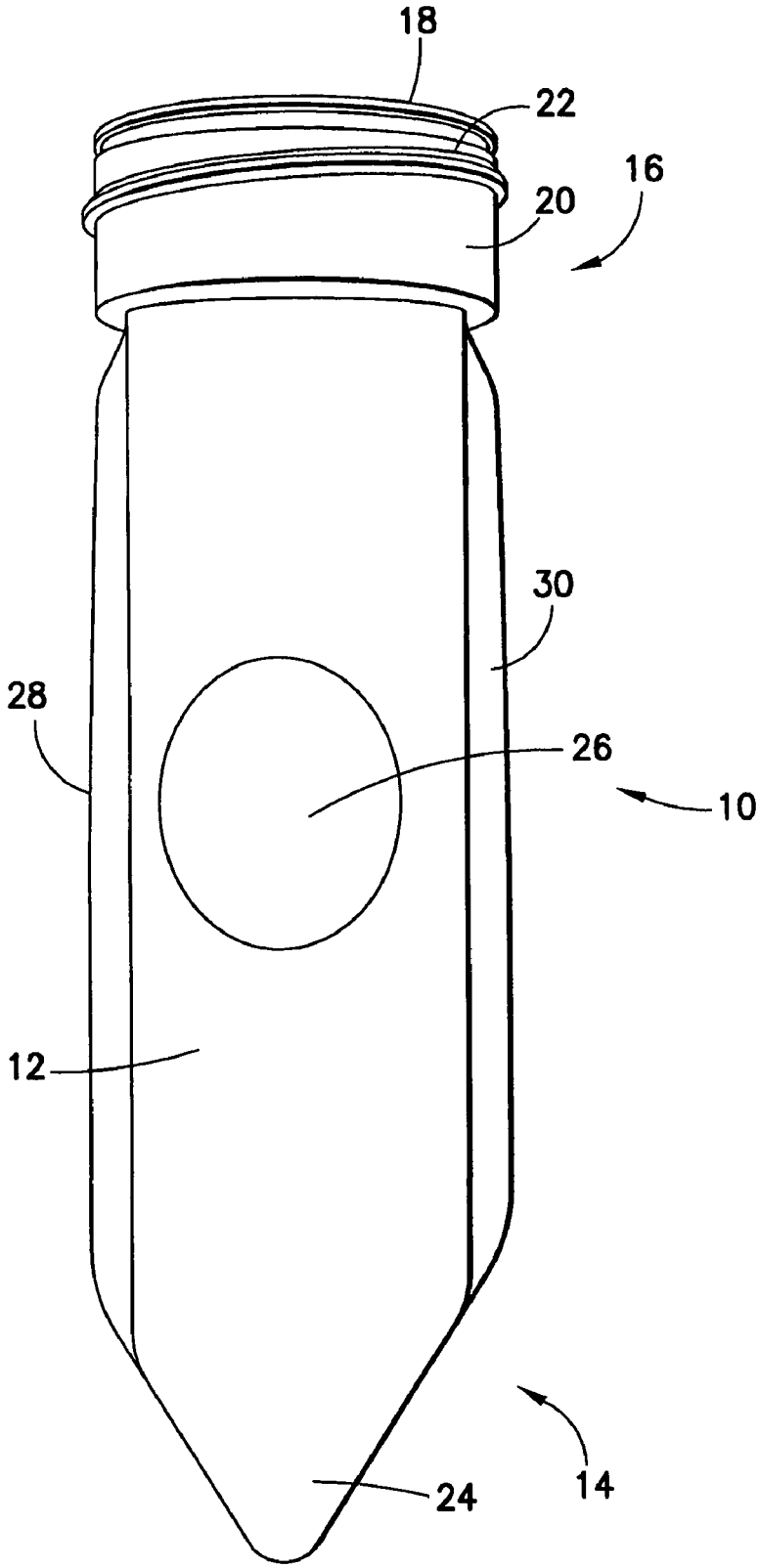
FIG. 1 is a perspective view of a centrifuge tube according to one embodiment of the present invention, showing the longitudinally extending hinge elements thereof.

The present invention is based on the discovery that centrifuge tubes can be formed with integral hinge elements at opposing sides of the generally cylindrical body of the tube, to permit the centrifuge tube to be manually squeezed to a flattened conformation, by manual pressure exerted on respective exterior surfaces of the generally cylindrical body intermediate the integral hinge elements.

This structure permits the tube to assume a flattened conformation while held in one hand by the user, so that a swab after contacting liquid in the tube can be squeezed out by drawing it through the flattened section of the interior volume of the tube, so that liquid is exuded from the swab article by the compressive wiping action of the squeezed-down interior wall surfaces in contact with the swab article. The specimen collected on the swab thereby can be more fully released from the swab and thereafter subjected to centrifugation and separation processing.

Centrifuge tubes of the prior art have been formed as injection molded articles of polymers of a highly rigid character. I have found that by forming the centrifuge tube, e.g., as an extrusion blow-molded article or as a rotationally molded (roto-molded) article from suitable polymeric material, such as for example polypropylene, polyvinyl chloride, polyethylene, etc., with integral hinge elements at opposing sides of the main body portion of the centrifuge tube, the centrifuge tube is susceptible to press-flat action by exertion of compressive force by opposed digits on exterior surfaces of the tube intermediate the integral hinge elements. The respective integral hinge elements therefore provide a flexural hinge structure at each of the opposing sides of the main body portion of the centrifuge tube, which permits the tube to be pressed to a flattened conformation at the region of local manual deformation.

Thus, a specimen swab after contact with specimen at the locus of collection may be inserted into the centrifuge tube containing liquid, and then withdrawn up the tube to a point where the user can grasp opposing side surfaces intermediate the opposing side seams and compress the respective sides of the tube intermediate of the seams toward each other until they are in proximity to one another describing a narrowed transverse cross-section of the tube, thereby defining a narrowed slot opening through which the swab element can be drawn to squeeze out the liquid so that specimen in the swab element is exuded and squeezed out into the liquid pool at the bottom portion of the tube, for subsequent concentration and analysis by the centrifugation operation.

The integral hinge elements may be constituted by any suitable structure that permits the centrifuge tube to be manually (digitally) compressed to a flattened conformation with less exertion of manual force than would be required in a correspondingly formed centrifuge tube lacking such structure. The integral hinge elements permit a flexural resilient flattening of the tube, and may be constituted in various embodiments of the invention by a spine, crest, ridge, projection, protrusion, corrugation, or other structural elements that extend longitudinally (parallel to the central axis of the centrifuge tube) along at least a part of the length of the main body portion of the tube.

The proximal open end of the centrifuge tube may be provided with coupling structure for matable engagement with a closure cap, so that the contents of the centrifuge tube are enclosed during the centrifugation operation.

For example, the exterior surface of the centrifuge tube at the proximal end thereof may be threaded in a manner complimentary to an interior cap surface threading, so that the centrifuge tube may be capped by a screw-on capping operation. Alternatively, the cap may be of a press-fit type. Other coupling arrangements by which the cap can be secured to the proximal end portion of the centrifuge tube are readily employed in the broad practice of the present invention, including opposedly facing detent and depression surface mating arrangements, rotationally securable couplings involving transversely extending protrusion and receiving slot arrangements, etc. In all instances, the cap should be readily applied to and removed from the proximal end portion of the centrifuge tube, without undue effort.

The centrifuge tube of the invention may be provided as a component of a kit including the centrifuge tube, a closure cap matably engagable therewith, and a swab article for specimen collection, wherein the swab article is of a size and confirmation permitting it to be interiorly disposed in the centrifuge tube, with a distal swab element in the distal portion of the centrifuge tube, and with a proximal end of the swab article terminating at or in proximity to the proximal end of the centrifuge tube. The cap may be configured with a slot, recess or opening therein that permits insertion therein of the distal end of the stick or wand element of the swab article, so that the cap positionally retains the swab in a fixed position.

Referring now to the drawings, FIG. 1 is a perspective view of a centrifuge tube 10 according to one embodiment of the present invention, showing the longitudinally extending integral hinge elements 28, 30 at respective sides of the centrifuge tube.

As illustrated, the centrifuge tube 10 comprises an elongate cylindrical main body portion 12, having a closed distal end 14 and a proximal end 20 circumferentially bounding a proximal opening 18. The proximal end portion 20 features threading 22 on an upper surface portion thereof adjacent to the proximal opening 18, for mating with a complimentarily threaded cap, to close the tube when holding contents to be centrifuged. As further illustrated, the body 12 has a substantially uniform diameter along the open proximal end 20. Furthermore, relative to a central longitudinal axis extending through the closed distal end 14 and the open proximal end 20, the open proximal end 20 has a cross-sectional area (in a direction perpendicular to the central axis) at least as large as the cross-sectional area of the centrifuge tube 10.

Figure 2:
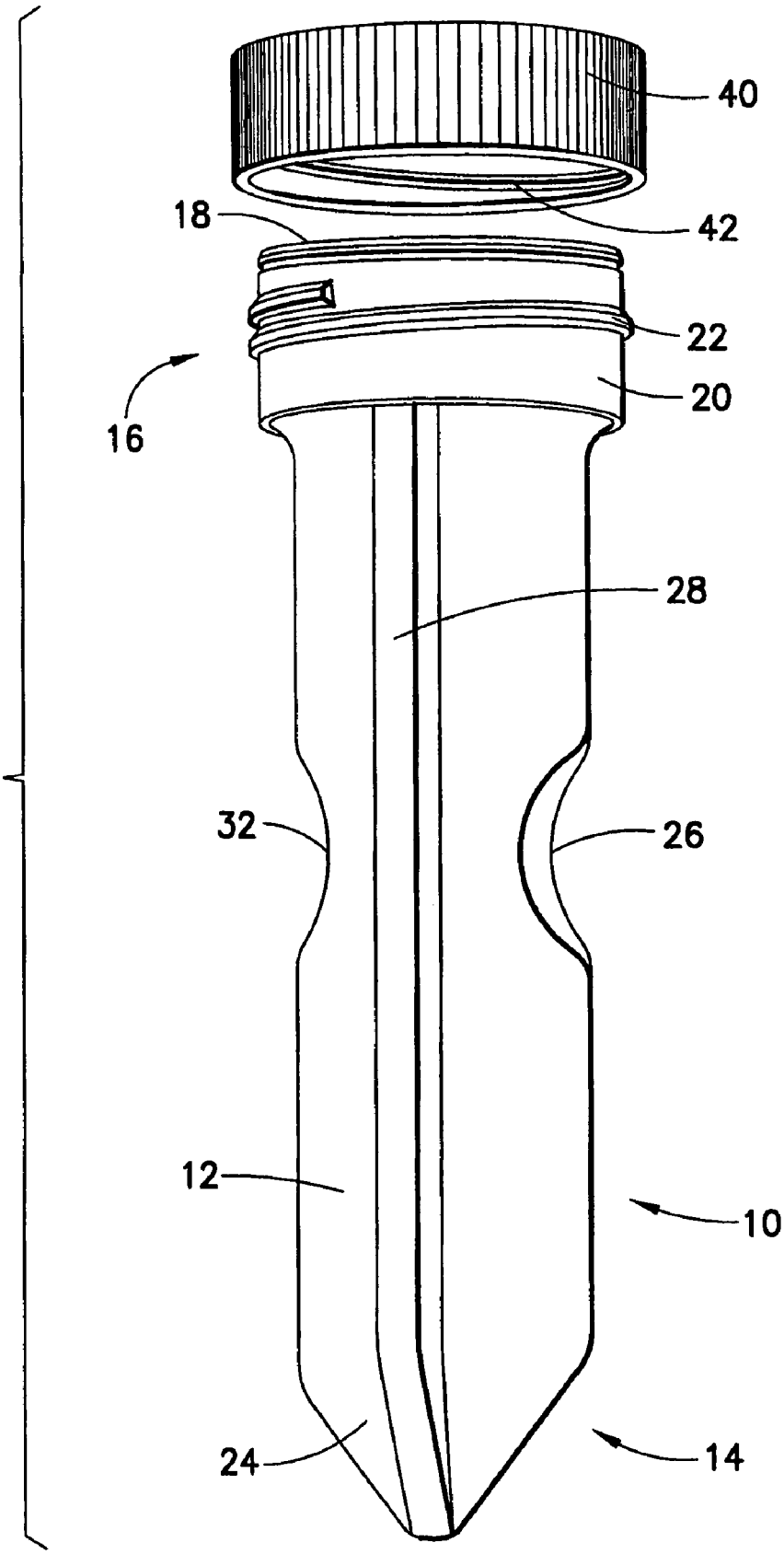
FIG. 2 is a perspective view of the centrifuge tube as in FIG. 1 together with a cap therefor.

The integral hinge elements 28, 30 at opposite sides of the main body 12, diametrically opposite one another, and on the surface intermediate the integral hinge elements is a concave depression 26 which may for example be on the order of about 0.5-0.75 inch diameter, when the tube is of a 1-inch inner diameter. Such depression 26 is diametrically opposite a corresponding depression 32, as shown in FIG. 2, wherein all parts are numbered correspondingly with respect to FIG. 1. The distal end 14 of the centrifuge tube may as shown be provided with a conical projection 24, providing a distal receptacle portion that is accommodated to collection and compaction of solids during the centrifuge operation.

The centrifuge tube may be of any suitable size and dimensions. For the aforementioned illustrative ~1-inch inner diameter centrifuge tube, the tube length, as measured along the axial center line of the tube from the tip of the distal conical end to the proximal opening, may be on the order of about 3-8 inches.

FIG. 2 is a perspective view of the centrifuge tube 10 of FIG. 1, showing the opposed depressions 26, 32 which accommodate manual grasping of the centrifuge tube, e.g., with a thumb and forefinger in the respective depressions, to accommodate squeezing of the tube. In this manner, the integral hinge elements 28, 30 (integral hinge element 30 not being clearly visible in FIG. 2) provide a hinge structure at each side of the tube, permitting the centrifuge tube to be transversely flattened so that the opposing concave depression 26 and 32 are translated toward one another, to provide a narrowed interior slot in the interior volume of the tube.

The proximal end portion 20 of the centrifuge tube 10 is provided with threading 22 complimentary to threading 42 of the cap 40, which thereby is adapted for matable engagement to close the proximal opening 18 of the tube and enclose its contents.

Figure 3:
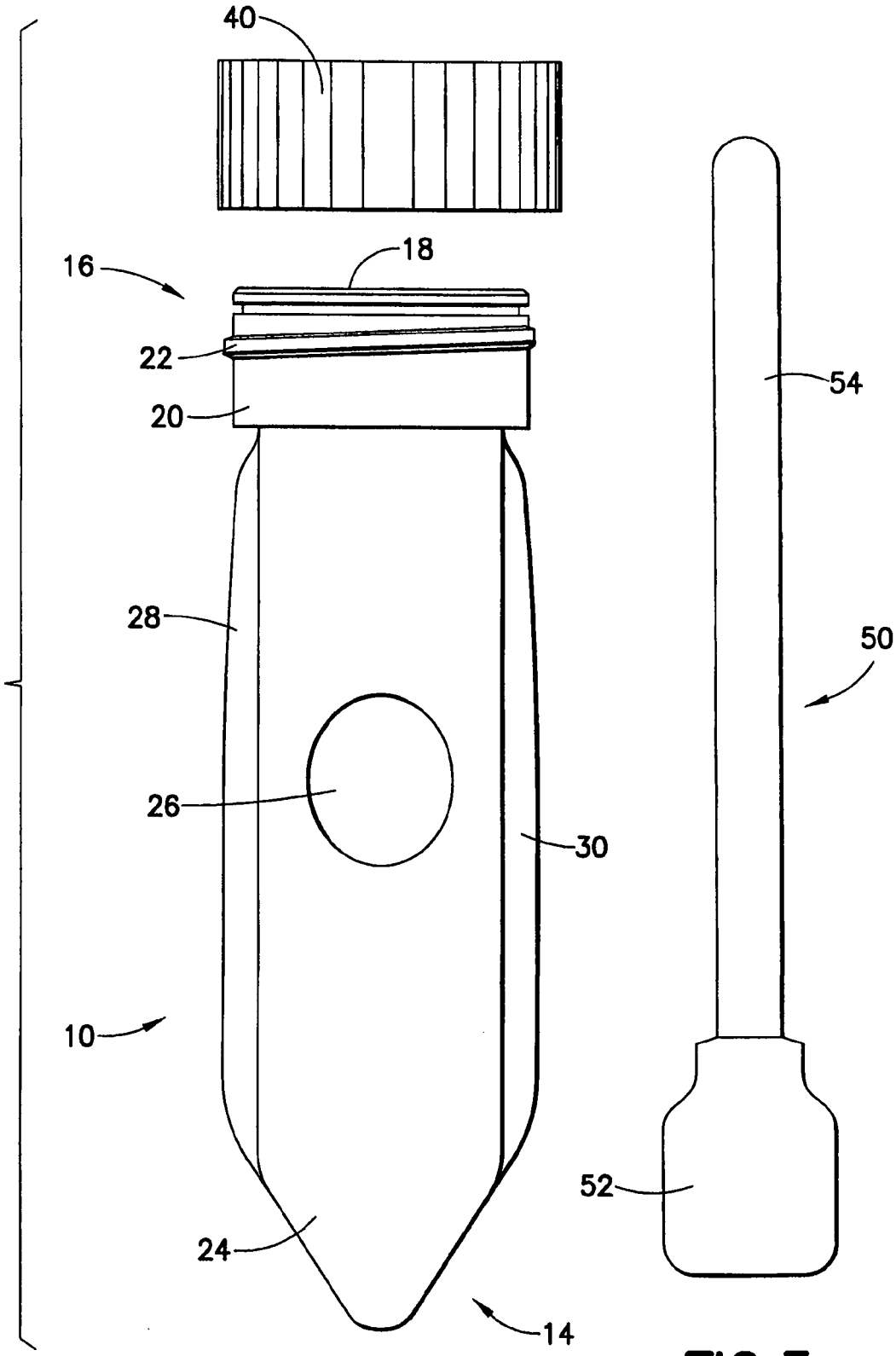
FIG. 3 is a perspective view of the centrifuge tube FIG. 1, with the cap as shown in FIG. 2, and a swab article for use with the centrifuge tube.

FIG. 3 is a perspective view of a kit in accordance with another aspect of the invention, comprising the centrifuge tube 10, whose parts are numbered corresponding to those of FIGS. 1 and 2, the centrifuge tube cap 40 and a specimen collection swab article 50.

The swab article 50 as shown as a specimen collection element 52 at the distal end thereof, secured to the end of a wand or stick 54 permitting the article to be grasped at its proximal end, so that the swab element 52 can be contacted with the specimen or site from which evidence, or other specimen may be collected.

Figure 4:
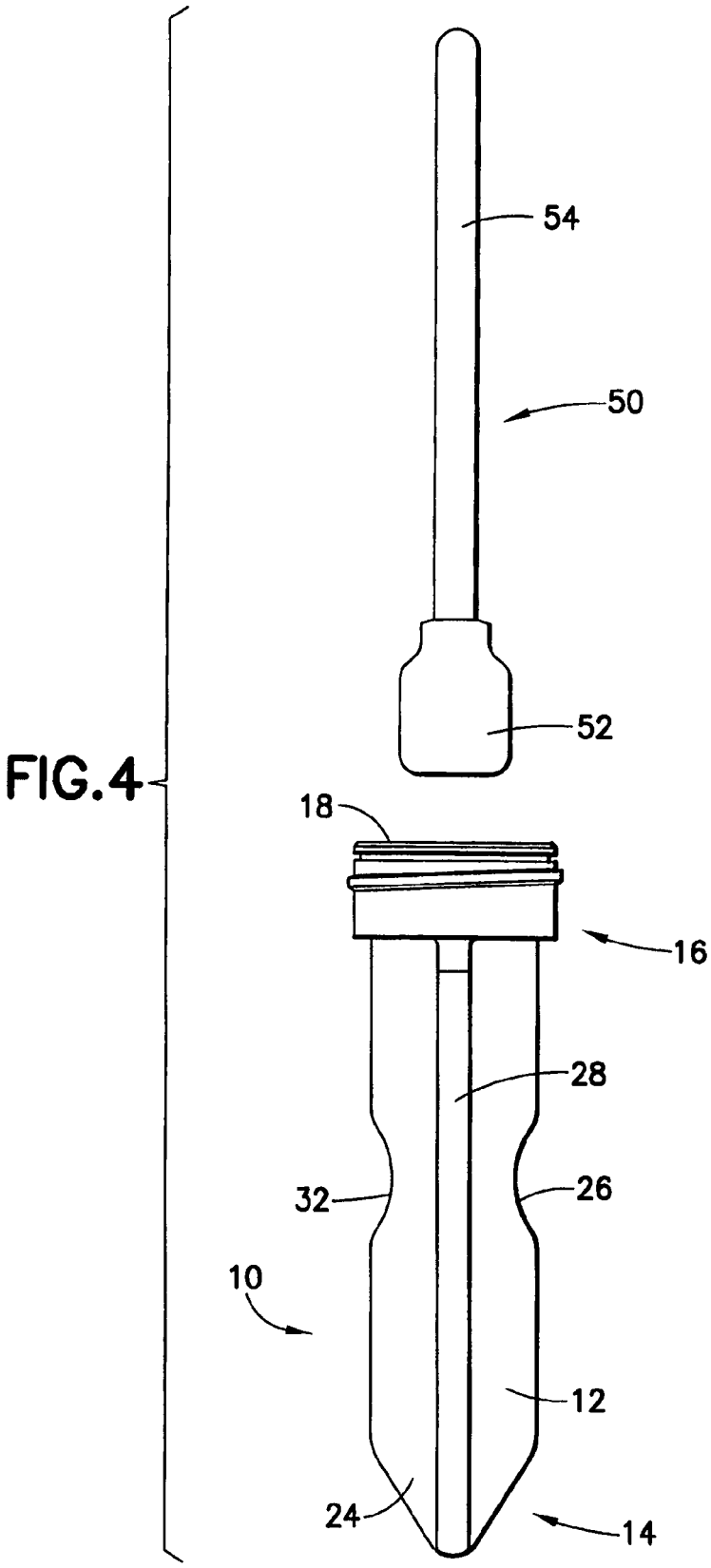
FIG. 4 is a perspective view of the centrifuge tube of FIG. 1, showing same with a swab article axially aligned with the proximal open end of the centrifuge tube, positioned for insertion of the distal swab element into the interior volume of the centrifuge tube.

FIG. 4 is a perspective view of the centrifuge tube 10, whose parts are numbered correspondingly with those of FIGS. 1-3, shown in axial spaced-apart relationship to swab article 50, whose parts are numbered correspondingly to those shown in FIG. 3 for such article.

Figure 5:
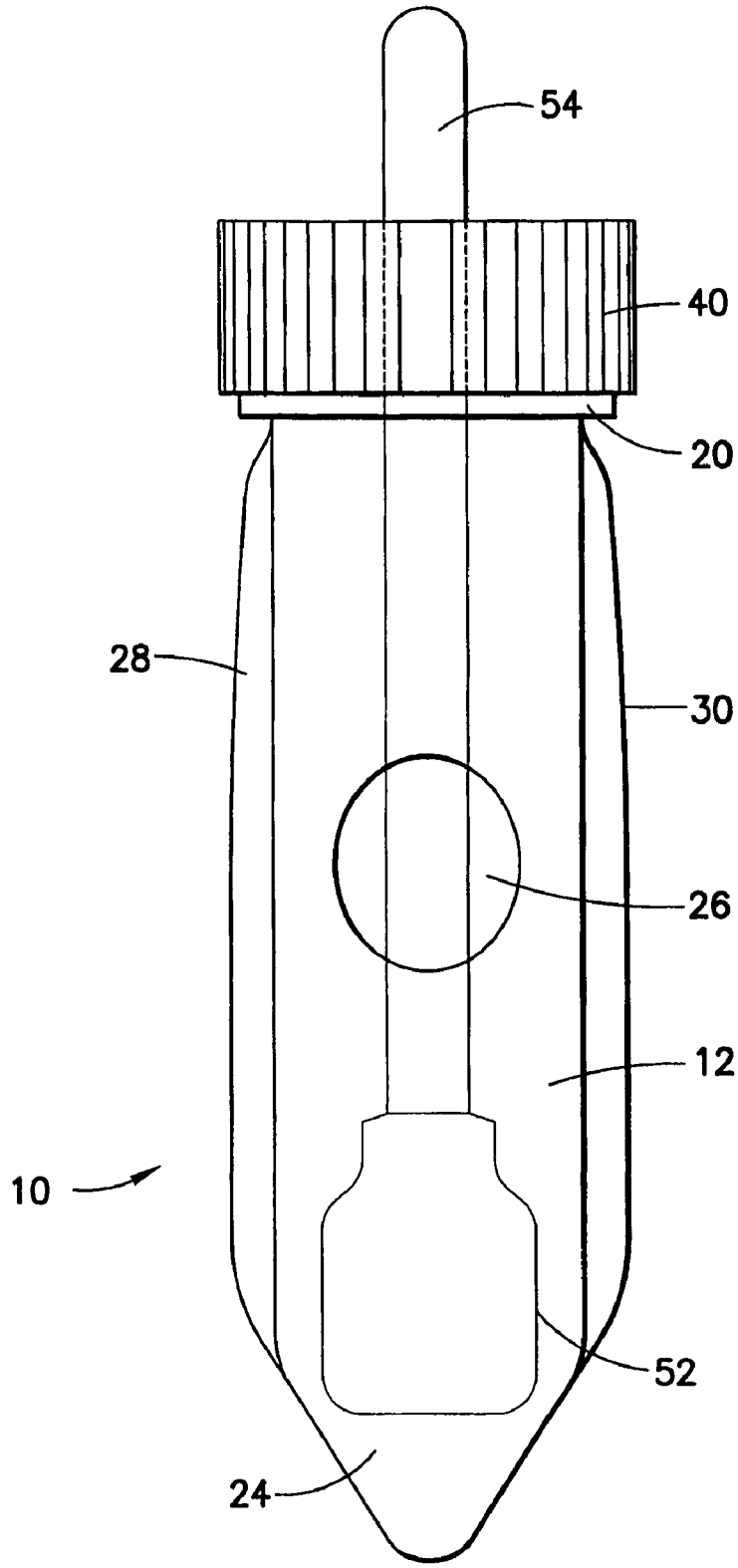
FIG. 5 is a side view of the centrifuge tube of FIG. 1, having a swab article interiorly disposed therein, with a cap arranged to retain the swab in a predetermined position.

The swab article 50 is adapted to be translated downwardly into the interior volume of the centrifuge tube 10, so that the swab element 52 is reposed in the conical end portion 24 of the tube. As shown in FIG. 5, wherein all parts are numbered correspondingly with respect to the same parts and structure in preceding drawings, the swab element 52 is reposed in the conical distal end portion 24 of tube 10, and tube 10 is shown as engaged with cap 40. Cap 40 in the FIG. 5 embodiment is provided with a central opening through which the proximal end of wand or stick 54 protrudes from the capped centrifuge tube, as shown.

Referring again to FIG. 4, showing the swab article 50 and centrifuge tube 10 in axial spaced-apart relationship to one another, it will be seen that the centrifuge tube can readily be grasped by a user with thumb and forefinger reposed in the respective concave depressions 26 and 32 on opposite side surfaces of the centrifuge tube, and that the exertion of manual pressure by the thumb and forefinger will serve to flatten the centrifuge tube by virtue of the integral hinge elements 28 and 30 (integral hinge element 30 not visible in FIG. 4, but shown for example in FIG. 3), and such action therefore provides a narrowed slot opening in the interior volume of the centrifuge tube, against which the swab element 52 can be translated, to "wring out" liquid on such swab element, so that same is released from the swab element into the lower portion of the centrifuge tube. The swab therefore may simply be immersed in liquid to wet the swab element, after contacting the swab with the specimen collection site to collect specimen on the swab element, followed by placing the swab element between the opposedly facing concave depressions 26 and 32, and squeezing the tube against the swab article to cause compressively-mediated exudation of liquid therefrom, so that the specimen-containing liquid drops into the distal end portion 24 of the centrifuge tube. In this manner, the wetted swab article is drawn through the narrowed slot formed by manual pressure on concave depressions 26 and 32, to ring out the liquid and maximize the release of specimen from the swab element, as the swab is withdrawn from the centrifuge tube, and prior to final capping of the tube to ready it for centrifugation.

Accordingly, the invention variously contemplates centrifugation with the swab article disposed in the centrifuge tube, as well as centrifugation wherein the swab has been caused to release the collected specimen into the interior volume of the tube and the swab has been discarded before capping of the centrifuge tube.

It will be recognized that the provision of opposedly facing dimples or concave depressions on the main body of the cylindrical tube is an optional feature that in some instances may be utilized to facilitate release of specimen from the swab element. In other embodiments of the invention, the tube may be devoid of such concave depressions. In still other embodiments, the tube may be provided at intermediate surface along its length, between the respective integral hinge elements, with ribs, protrusions, grips, or other elements that facilitate the squeezing and flattening compression of the centrifuge tube.

It will therefore be appreciated that the centrifuge tube of the invention is constructed and arranged with integral hinge elements at opposite sides thereof that facilitate the compression flattening of the tube, by exertion of pressure on exterior surfaces of the tube intermediate the integral hinge elements.

The centrifuge tube of the invention is readily formed by extrusion blow molding or rotational molding processes, using suitable polymeric material for the molding process. Illustrative polymeric materials include, without limitation, polypropylene, polyethylene, polyvinylchloride, polyurethane, polybutylene, etc., as appropriate to a specific design and end use application of the centrifuge tube. The wall thickness of the centrifuge tube will depend on the material of construction and its flexural modulus. The centrifuge tube may for example have a wall thickness that is greater than 5 mils (0.005 inch) in thickness and a flexural modulus that is greater than 100,000 psi, although the specific wall thickness and flexural modulus can be widely varied in the broad practice of the present invention, dependent on the polymeric material employed.

FIG. 6 is a schematic representation of a centrifuge tube 100 according to another embodiment of the invention, including a cylindrical main body 102, having integral hinge ridges 108 and 110 at opposite sides of the main body. The centrifuge tube has a central axis L-L as illustrated, and has a closed conical-shaped distal end 106 and an open proximal end 104. On the exterior surface of the tube, intermediate the respective hinge elements, are depressions 112 and 118, as shown in FIG. 7, which is a schematic representation of the centrifuge tube of FIG. 6, axially rotated 90° from the position of the tube shown in FIG. 6.

FIG. 8 is a cross-sectional representation of the centrifuge tube of FIG. 6, taken along line 8-8 of FIG. 6, showing the integral hinge ridges 108 and 110 diametrically opposite one another at diameter line A, designating the inner diameter. In this embodiment, the inner diameter A may be on the order of 25 mm, with the outer diameter B being on the order of 30 mm. As shown, the integral hinge elements in this embodiment are of generally triangular cross-section, with an included angle between lines extended from the respective exterior surface of the integral hinge element being 90°. In general, hinge elements are preferred whose corresponding included angle is less than 180°, as measured between lines coincident with or tangent to the hinge structure at the respective lateral margins thereof.

FIG. 9 is a schematic representation of a centrifuge tube 150 according to another embodiment of the invention, having integral hinge elements 152 and 154 that extend along the full length of the main body portion of the tube.

FIG. 10 is a schematic representation of a centrifuge tube 160 according to yet another embodiment of the invention, wherein the integral hinge elements 162 and 164 extend only partially along the length of the tube, at an upper part thereof. It will be recognized that the hinge elements can be widely varied in the practice of the invention, and may extend longitudinally along the main body portion of the tube in a continuous, partial, or intermittent or other manner.

FIG. 11 is a simplified cross-sectional view of a centrifuge tube 200 according to another embodiment of the invention, having a hinge element structure comprising radially outwardly converging hinge elements 204 and 206. The tube encloses an interior volume 202 and the regions of manual compression force exerted on the tube to flatten it are indicated by arrows 208 and 210.

FIG. 12 is a simplified cross-sectional view of a centrifuge tube 220 according to a still further embodiment of the invention, showing the hinge element structure comprising corrugated protrusions 222 and 224 and indicating in dashed line representation the flattened conformation 226 of the centrifuge tube subsequent to exertion of manual compressive force on the tube (in the directions indicated by opposing arrows 228 and 232) by the opposing digits 230 and 234 of a user, as illustrated.

Accordingly, while the invention has been illustratively described in reference to specific aspects, features and embodiments, it will recognized that the invention is not thus limited, and that the invention may be amenable to embodiment in other variations, modifications and forms. Accordingly, the invention as hereinafter claimed is intended to be broadly construed and interpreted, to include all such variations, modifications and forms within its spirit and scope.

What is claimed is:

1. A centrifuge tube having a body with a closed distal end, an open proximal end, and integral hinge elements at opposing sides of the body to facilitate compression flattening of at least a portion of the body, wherein the body has a substantially uniform diameter along the open proximal end, and wherein the body comprises concave depressions on an exterior surface of the tube, opposedly facing one another, between the respective integral hinge elements.

2. The centrifuge tube of claim 1 wherein the body has a central axis extending through the closed distal end and the open proximal end, the body has an average cross-sectional area in a direction perpendicular to the central axis, and the open proximal end has a cross-sectional area at least as large as the average cross-sectional area.

3. The centrifuge tube of claim 1, further comprising a cap matably engageable with coupling structure at the proximal end of the centrifuge tube.

4. The centrifuge tube of claim 1, wherein each of the integral hinge elements comprises any of a ridged structure, a corrugated protrusion structure, and a protrusion of generally triangular cross-section.

5. The centrifuge tube of claim 1, formed by a molding technique selected from the group consisting of extrusion blow molding and rotational molding.

6. The centrifuge tube of claim 1, having a generally cylindrical form, an inner diameter of up to about one inch, and a length in a range of from about 3 inches to about 8 inches.

7. The centrifuge tube of claim 1, formed of a polymer selected from the group consisting of polypropylene, polyethylene, polyvinylchloride, polybutylene and polyurethane.

8. A specimen collection kit comprising the centrifuge tube of claim 1, a cap matably engagable with the proximal end of the centrifuge tube, and a swab article having a swab element adapted to collect a specimen and sized such that the swab element may be inserted through the proximal end into an interior portion of the centrifuge tube.

9. A centrifuge tube having a body with a closed distal end, an open proximal end, and integral hinge elements at opposing sides of the body to facilitate compression flattening of at least a portion of the body, wherein the body has a central axis extending through the closed distal end and the open proximal end, the body has an average cross-sectional area in a direction perpendicular to the central axis, the open proximal end has a cross-sectional area at least as large as the average cross-sectional area, and the body comprises concave depressions on an exterior surface of the tube, opposedly facing one another, between the respective integral hinge elements.

10. The centrifuge tube of claim 9, further comprising a cap matably engageable with coupling structure at the proximal end of the centrifuge tube.

11. The centrifuge tube of claim 9 wherein each of the integral hinge elements comprises any of a ridged structure, a corrugated protrusion structure, and a protrusion of generally triangular cross-section.

12. The centrifuge tube of claim 9, formed by a molding technique selected from the group consisting of extrusion blow molding and rotational molding.

13. The centrifuge tube of claim 9, having a generally cylindrical form, an inner diameter of up to about one inch, and a length in a range of from about 3 inches to about 8 inches.

14. The centrifuge tube of claim 9, formed of a polymer selected from the group consisting of polypropylene, polyethylene. Polyvinylchloride, polybutylene and polyurethane.

15. A specimen collection kit comprising the centrifuge tube of claim 9, a cap matably engagable with the proximal end of the centrifuge tube, and a swab article having a swab element adapted to collect a specimen and sized such that the swab element may be inserted through the proximal end into an interior portion of the centrifuge tube.

16. An analytical method comprising the steps of:

providing a swab article having a swab element adapted to collect a specimen;

providing a centrifuge tube having a body with a closed distal end, an open proximal end, and integral hinge elements at opposing sides of the body to facilitate compression flattening of at least a portion of the body, wherein the body has a substantially uniform diameter along the open proximal end, and wherein the body comprises concave depressions on an exterior surface of the tube, opposedly facing one another, between the respective integral hinge elements;

contacting a specimen with the swab element;

inserting the swab element through the open proximal end into an interior portion of the centrifuge tube;

compressively flattening at least a portion of the body to contact and compress the swab element to extract at least a portion of the specimen.

17. The method of claim 16, further comprising the step of inserting the centrifuge tube into a centrifuge and subjecting the centrifuge tube and its contents to centrifugation.

18. The method of claim 16, wherein the body has a central axis extending through the closed distal end and the open proximal end, the body has an average cross-sectional area in a direction perpendicular to the central axis, and the open proximal end has a cross-sectional area at least as large as the average cross-sectional area.

* * * * *

UNITED STATES PATENT AND TRADEMARK OFFICE

CERTIFICATE OF CORRECTION

PATENT NO. : 7,337,907 B2
APPLICATION NO. : 10/633238
DATED : March 4, 2008
INVENTOR(S) : Tilak M. Shah It is certified that error appears in the above-identified patent and that said Letters Patent is hereby corrected as shown below:

Column 8, line 56 (claim 14): "ethylene. Polyvinylchloride" should be -- ethylene, polyvinylchloride --.

Signed and Sealed this

Twenty-second Day of July, 2008

JON W. DUDAS
*Director of the United States Patent and Trademark Office*